US005236160A

United States Patent [19]

Sechelski

[11] Patent Number: 5,236,160

[45] Date of Patent: Aug. 17, 1993

[54] LAMP SUPPORT APPARATUS

[76] Inventor: Nathan T. Sechelski, 811 Horlock, Navasota, Tex. 77868

[21] Appl. No.: 631,218

[22] Filed: Dec. 21, 1990

Related U.S. Application Data

[63] Continuation of Ser. No. 358,552, May 26, 1989, abandoned.

[51] Int. Cl.[5] ..... F21S 1/12

[52] U.S. Cl. ..... 248/125; 248/160; 362/419; 362/431

[58] Field of Search ..... 362/33, 258, 285, 287, 362/568, 371, 410, 413, 414, 418, 419, 427, 429, 431, 432; 248/160, 125, 316.7, 187, 106, 105, 107

[56] References Cited

U.S. PATENT DOCUMENTS

| | | | |
|---|---|---|---|
| 1,403,863 | 1/1922 | Peat . | |
| 1,481,998 | 1/1924 | Eldredge . | |
| 1,498,054 | 6/1924 | Manley | 248/130 |
| 2,300,915 | 1/1942 | Florence | 248/168 |
| 2,663,764 | 12/1953 | Holmes | 248/279 |
| 2,778,931 | 11/1957 | Cruz | 240/52.5 |
| 2,813,196 | 11/1957 | Dempsey | 240/57.1 |
| 3,593,016 | 7/1971 | Gerdel | 240/8.18 |
| 3,725,696 | 4/1973 | Morton | 240/84 |
| 3,783,262 | 1/1974 | Pile | 362/427 |
| 3,828,181 | 8/1974 | Goodwin | 240/54 |
| 3,961,176 | 6/1976 | Gleason | 362/413 |
| 4,208,703 | 6/1980 | Orr | 362/287 |
| 4,228,489 | 10/1980 | Martin | 362/250 |
| 4,232,357 | 11/1980 | Dietz | 362/285 |
| 4,369,487 | 1/1983 | Carlow | 362/258 |
| 4,458,304 | 7/1984 | Imsdahl | 362/387 |
| 4,523,256 | 6/1985 | Small | 362/427 |
| 4,528,622 | 7/1985 | Bacevius | 362/396 |
| 4,587,603 | 5/1986 | Hughes | 362/427 |
| 4,678,153 | 7/1987 | Maddock et al. | 362/396 |
| 4,772,993 | 9/1988 | Engel | 362/419 |
| 4,907,769 | 3/1990 | Hunley, Jr. et al. | 248/316.7 |

FOREIGN PATENT DOCUMENTS

| | | |
|---|---|---|
| 487881 | 6/1938 | United Kingdom . |
| 494474 | 10/1938 | United Kingdom . |

OTHER PUBLICATIONS

*Webster's Ninth New Collegiate Dictionary*, Merriam-Webster Inc., ©1990.

*Primary Examiner*—Ira S. Lazarus
*Assistant Examiner*—L. Heyman
*Attorney, Agent, or Firm*—Alton W. Payne

[57] ABSTRACT

A lamp supporting apparatus. The apparatus is designed for holding and positioning a lamp of the type which has a light source, an elongated handle depending therefrom and an electrical supply cord attached at a lower end of the handle. The supporting apparatus includes a base member and an upstanding support leg which has a lower end secured to the base member and an upper end which is extendable from the lower end for adjusting the height. A support arm has a first end pivotally attached at the upper end of the support leg, and a sleeve is secured to the second end of the arm. The sleeve has a longitudinal aperture on one side thereof for transverse passage of the electrical supply cord of the lamp therethrough. The sleeve has a diameter which is intermediate the diameter of the handle and the light source so that the handle of the lamp is receivable axially into the sleeve, and the lamp is supportable and positionable by the apparatus.

8 Claims, 3 Drawing Sheets

LAMP SUPPORT APPARATUS

This is a continuation of copending application Ser. No. 07/358,552 filed on May 26, 1989, now abandoned.

FIELD OF THE INVENTION

This invention relates to portable electric lamps, and more particularly to devices for the support and positioning of such lamps.

BACKGROUND OF THE INVENTION

Utility lamps are commonly used by automechanics and other workers for lighting poorly lit or darkened working environments. A popular utility lamp has a light source, an elongated handle depending therefrom and an electrical supply cord attached at another, lower end of the handle opposite the light source. The light source is typically an incandescent light bulb in a socket mounted in one end of the handle and usually includes a protective cage or shroud to prevent damage to the light bulb. The handle is typically tapered with a diameter adjacent the lower end thereof less than a diameter adjacent the light source. There may also be an electrical on-off switch positioned on one side of the handle, and in some cases, an electrical outlet or receptacle mounted on the same side of the handle as well. The electrical cord typically has one end extending through the handle and connected to the socket and the other end is adapted for connection to an electrical outlet supplying, for example, 110 volt AC power or 12 volt direct current.

Such utility lamps are typically supported or hung overhead by means of a hook secured to the protective cage around the light bulb. However, when no place is available to hang the lamp by the hook, there is no universally convenient stand or support device available to facilitate support and positioning of the utility lamp. For example, the utility lamp support and storage device described in U.S. Pat. No. 4,458,304 to Imsdahl, has a flat frame with an aperture therein for receiving and encompassing a utility lamp and a swingable bail for supporting the utility lamp in the frame in a generally upright position leaning against the bail. However, this device must be used with the lamp adjacent the floor or ground or other horizontal surface on which the frame is placed and only directs the light upwardly, and therefore is not particularly useful when the area to be illuminated is some distance above the horizontal surface. In addition, the frame is subject to being accidently knocked over when bumped from the side of the frame on which the bail is extended. Nor can the Imsdahl device be readily used with a utility lamp having a retractable electrical cord. Other utility lamps adapted for hanging have similar shortcomings, such as, for example, those described in U.S. Pat. Nos. 4,369,487 to Carlow and 3,593,016 to Gerdel.

Various portable light clamping devices, e.g. flashlight stands, are known from, for example, U.S. Pat. Nos. 1,481,998 to Eldredge; 2,300,915 to Florence; and 2,778,931 to Cruz. These all have drawbacks similar to the Imsdahl device in that they must be positioned on the floor or another horizontal surface and/or the flashlight is clamped in place into the stand and cannot be readily removed when it is desired to use the flashlight apart from the stand.

Various lamp and lantern holding devices are known from, for example, U.S. Pat. Nos. 4,232,357 to Dietz; 4,228,489 to Martin; 4,208,703 to Orr; 3,725,696 to Morton; 2,813,196 to Dempsey; and 1,403,863 to Peat; and British Patent Specifications 494,474 by Matthies; and 487,881 by Parsons. However, these usually require specially adapted or built-in lamps and are not readily adaptable for use with the portable utility lamps described above with which this invention is concerned.

Accordingly, there is a need for a lamp supporting apparatus for holding and positioning a conventional lamp of the type having a cage-protected light source, an elongated handle depending therefrom having a diameter adjacent the light source which is larger than a diameter adjacent a lower end of the handle opposite the light source, and an electrical supply cord attached at the lower end of the handle, which apparatus is capable of positioning the light universally at the desired height and angle, and from which the utility lamp is readily removable for use thereof independent of the stand.

SUMMARY OF THE INVENTION

The present invention provides a lamp supporting apparatus for holding and positioning a utility lamp which has a tapered, elongated handle, a light source on one end of the handle which may be protected by a cage or shroud, and an electrical supply cord attached at an opposite end of the handle. The utility lamp supporting apparatus has a base member which may be adapted to rest on a horizontal surface such as a floor or the ground. An upstanding support leg with lower and upper ends is secured at the lower end thereof to the base member. A support arm with first and second ends has its first end pivotally attached to the upper end of the support leg. A sleeve is secured to the second end of the support arm for releasably receiving the lamp handle. A longitudinal aperture or slit is formed in one side of the sleeve so that the electrical supply cord may be readily transversely inserted or withdrawn from the sleeve.

In one embodiment, the support leg is extendable and retractable, and the apparatus may include means for releasably clamping the upper end of the leg to the lower end of the leg in a relative fixed, extended position. The apparatus may further include means for releasably clamping the first end of the arm in a fixed relative pivoted position with respect to the upper end of the leg.

In another embodiment, the sleeve may be elongated and cylindrical with a continuous side and an apertured side. An end of the sleeve distal, or towards the furthest end away from the first end of the support arm, may be tapered down in length from adjacent the continuous side of the sleeve to adjacent the apertured side thereof. This tapering presents a beveled surface for supporting the lamp.

The invention also provides a lamp supporting apparatus for holding and positioning a lamp which has a light source, an elongated handle depending therefrom, and an electrical supply cord attached at a lower end of the handle, wherein the handle has a maximum diameter adjacent the light source and a reduced or minimum diameter adjacent the lower end of the handle. The apparatus includes a base member, a support leg, a support arm, and a sleeve. The base member is adapted to rest on a horizontal surface. The support leg is upstanding from the base member and has telescopically engaged upper and lower ends for adjustably extending and retracting the leg. The lower end of the leg is attached to the base member at or near the geometric center of the base for stability. Means are provided for releasably securing the upper end of the leg to the lower end thereof in fixed relative extended position. The support arm has first and second ends. The first end is attached to the upper end of the support leg by releasable means for securing the support arm in relative position pivoted with respect to the support leg. The sleeve is elongated and cylindrical with an inside diameter which is larger than the minimum handle diameter adjacent the lower end thereof, and smaller than the maximum handle diameter adjacent the light source. The sleeve has a continuous side which is secured to the second end of the support arm. A relatively shorter longitudinally apertured side is disposed opposite from the continuous side of the sleeve. An end of the sleeve distal the first end of the support arm is tapered in increasing length from adjacent the aperture to adjacent the continuous side. The sleeve is thus adapted to receive the lamp by transverse passage of the cord through the aperture into the sleeve and subsequent axial insertion of the handle of the lamp into the sleeve so that the lamp is secured in the sleeve. The first and second ends of the support arm may be made pivotable with respect to each other, and are preferably pivotable in a plane defined by the pivoting of the first support arm end with respect to the upper end of the support leg.

DETAILED DESCRIPTION OF THE PREFERRED EMBODIMENTS

Figure 1:
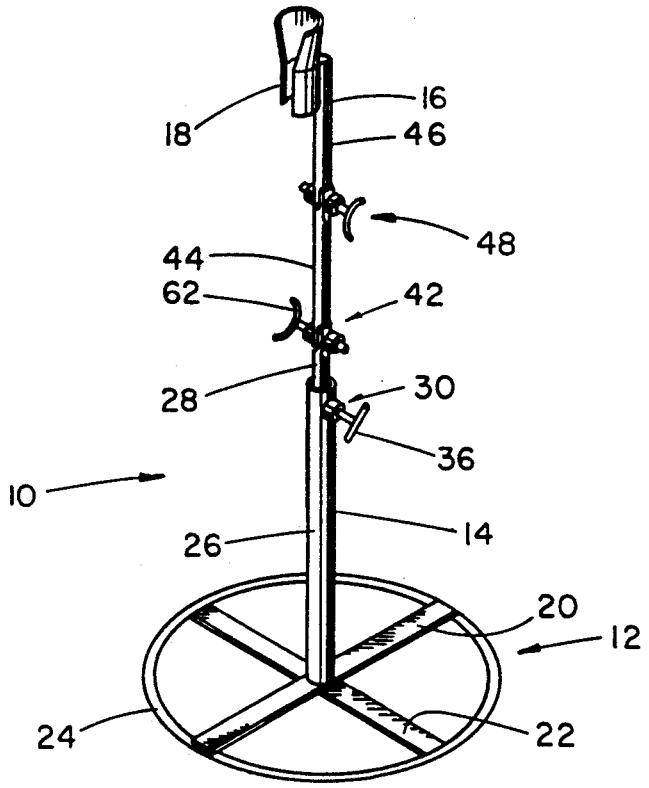
FIG. 1 is a perspective view of a lamp supporting apparatus according to the present invention.
Figure 2:
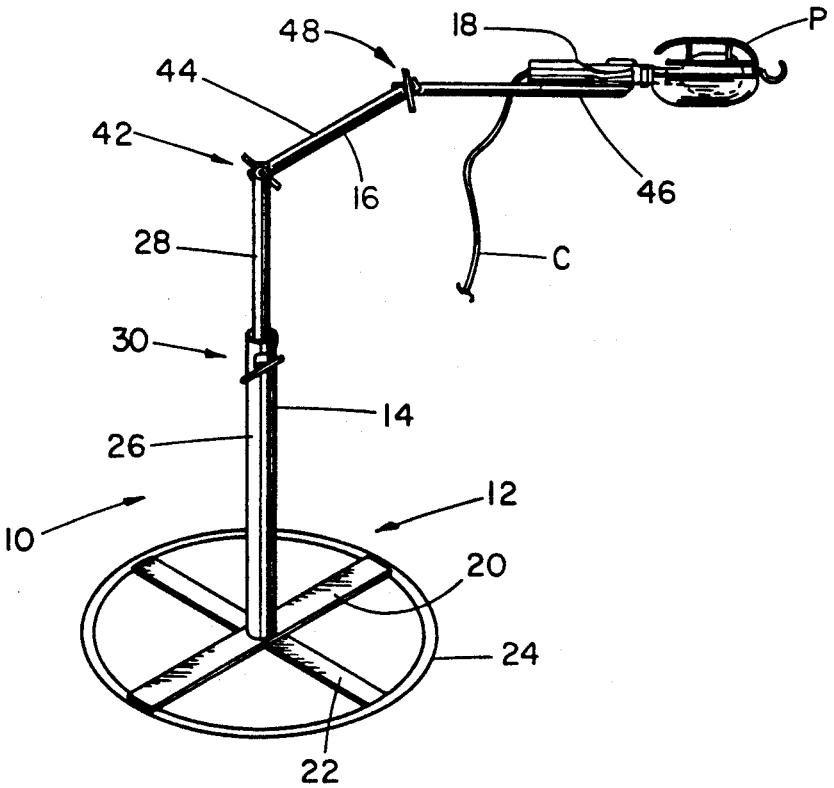
FIG. 2 is another perspective view of the apparatus of FIG. 1 shown in another position with a lamp held thereby.

Referring now to the drawings in which like parts are referenced by like numerals, the lamp supporting apparatus 10 has a base 12, a support leg 14, support arm 16 and a sleeve 18, as best seen in FIGS. 1 and 2. The base 12 is made from transverse members 20 and 22 and peripheral member 24. The transverse members 20 and 22 may be made of any suitable material, such as, for example, steel bar, and are secured together at an intersection thereof by, for example, bolting, riveting, welding, or the like. The peripheral member 24 is preferably a hoop secured at outer ends of the transverse members 20 and 22 by welding or otherwise. It is preferred to include peripheral member 24 to facilitate changing position of the apparatus using the operator's foot. However, the peripheral member 24 is optional and need not be included, particularly where it is desired to fold the base 12 for storage purposes as by, for example, rotatably securing the transverse members 20 and 22 together Alternatively, the base 12 may comprise, for example, a flat, planar member or any shape suitable for resting on a horizontal surface and which has sufficient horizontal dimensions so that the apparatus 10 is maintained in a relatively secure and stable upright position and is not easily tipped over by inadvertent bumping or other accidental impact.

Support leg 14 has a lower end 26 and an upper end 28 slidably engaged by lower end 26. The lower end 26 of the support leg 14 is attached to the base member 12, preferably adjacent a geometric center thereof. The lower end 26 of the support leg 14 may be fixedly attached to the base 12 by bolting, welding, etc. The leg 14 is upstanding, and preferably rises substantially vertically above the base 12. The upper end 28 and the lower. end 26 of the leg 14 are preferably telescopically interengaged so that the height of the support leg 14 may be adjusted. A clamping mechanism 30 is provided for securing the upper end 28 of the support leg in an extended or retracted position with respect to the lower end 26. While the support leg 14 is preferably generally tubular with the upper end 28 and lower end 26 having circular cross-sections and with the upper end 28 received in the lower end 26, various other forms of suitable extendable and retractable support legs are contemplated, such as, for example, square or other shaped cross-sections, as well as alternate clamping devices such as, for example, screws, set screws, bolts, and the like. Further it will be readily appreciated that, while two telescoping sections 26 and 28 of the leg 14 are illustrated for exemplary purposes, three or more telescoping sections may be provided as desired.

Figure 3:
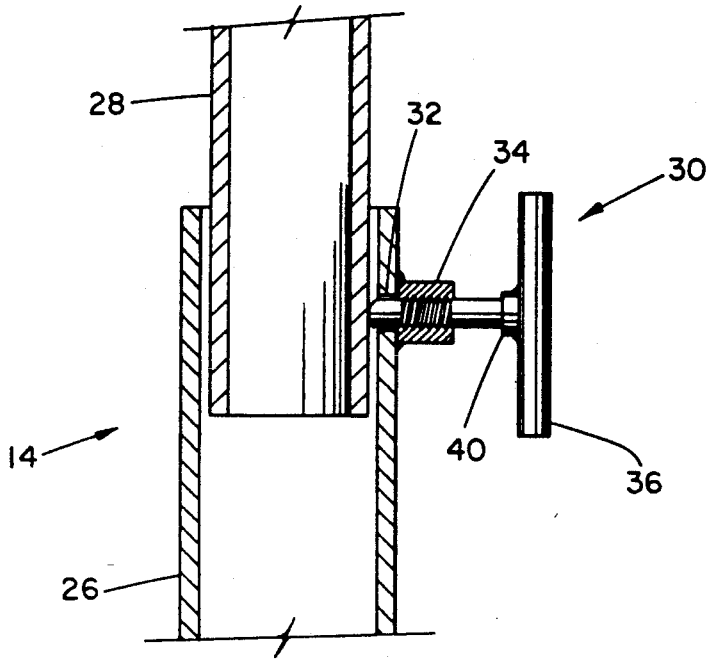
FIG. 3 is a side sectional view of a portion of the upstanding support leg used in the apparatus of FIGS. 1 and 2.

In one preferred embodiment illustrated in FIG. 3, the mechanism 30 is formed adjacent an upper terminus of the lower support leg end 26 by forming a transverse bore 32 in a side wall thereof and welding a threaded nut 34 around the bore 32. A handle 36 is welded to the head of a bolt 40. The bolt 40 is threadedly engaged in the nut 34 and extends through the bore 32 with an end in abutment with the upper support leg end 28. The upper end 28 of the leg 14 is held in relative extended position at the desired height by tightening the bolt 40 with the handle 36 so that the bolt 40 presses firmly against the upper end 28 of the leg 14 to securely hold it in the desired vertical position. The height of the leg 14 can be adjusted by loosening the bolt 40 using the handle 36 and sliding the upper end 28 relative to the lower end 26 to the desired position and retightening the bolt 40.

The upper end 28 of the support leg 14 terminates at a pivotable attachment 42 to support arm 16. The support arm 16 includes a first end 44 and a second end 46. First end 44 of the support arm 16 terminates at the pivotable attachment 42 with the upper end 28 of the support leg 14. The sleeve is is affixed on the support arm 16 adjacent the second end 46 thereof. It is preferred to include a pivotable attachment 48 between the first end 44 and the second end 46 of the support arm 16, but, if desired, the support arm 16 may be a continuous, unjointed elongated member. The pivotable attachment 48 preferably permits pivoting of the second end 46 of the arm 16 with respect to the first end 44 of the arm 16 in a plane common to that in which pivoting occurs at the attachment 42. The pivotable attachments 42 and 48 permit the sleeve 18 to be independently angled so that the lamp may be made to emit light in any desired direction.

Figure 4:
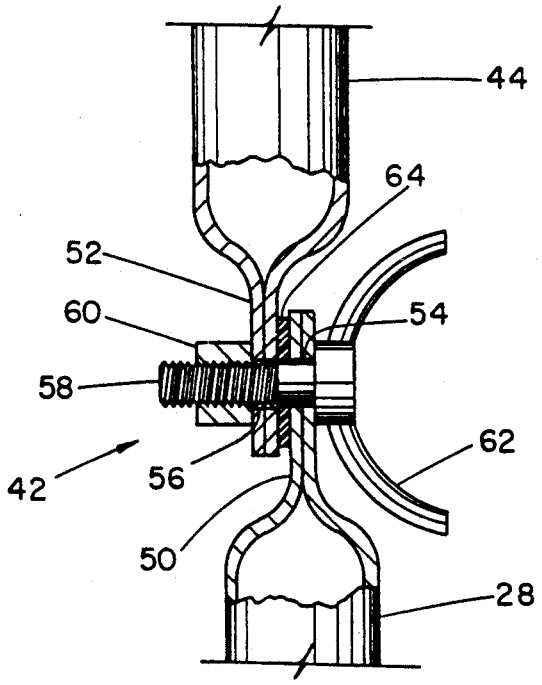
FIG. 4 is a side sectional view of the pivotable attachment between the support leg and the support arm used in the apparatus of FIGS. 1 and 2.
Figure 5:
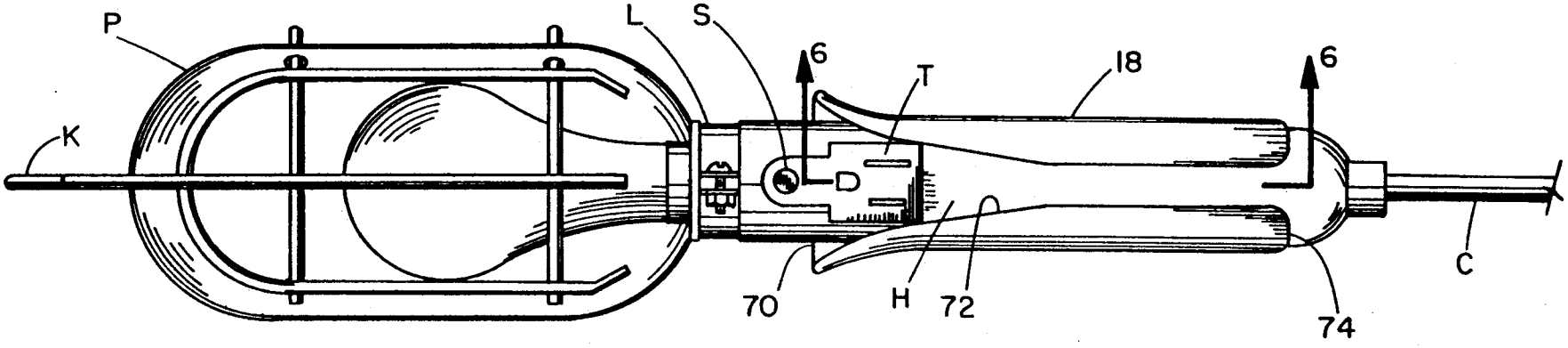
FIG. 5 is an enlarged side perspective view of a lamp supported in the sleeve of the apparatus of FIG. 2.
Figure 7:
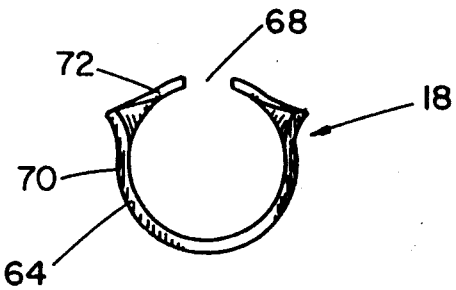
FIG. 7 is an end view of the sleeve of FIG. 3 as seen along the lines 7—7.
Figure 6:
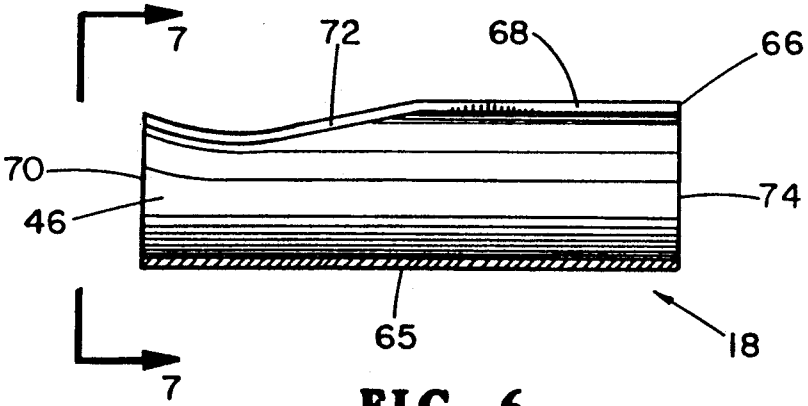
FIG. 6 is a side sectional view of the sleeve of FIG. 3 as seen along the lines 6—6.

The attachments 42 and 48 are preferably releasably securable in locked pivoted positions to facilitate positioning of the second end 46 of the support arm 16 in the desired vertical, lateral and angular position. In one preferred embodiment illustrated in FIG. 4, the pivot 42 is formed at flattened termini 50 and 52 of the respective upper end 28 of the support leg 14 and first end 44 of the support arm 16. The flattened sections 50 and 52 are formed conventionally by compressing ends of the tubular members comprising the respective upper support leg end 28 and first support arm end 44. Transverse perforations 54 and 56 are formed in the respective flattened sections 50 and 52 for receiving bolt 58. A nut 60 is welded or otherwise affixed on one side of the flattened section 52 coaxially with the perforation 56 for threadedly engaging the bolt 58. A handle 62 is welded or otherwise affixed to a head of the bolt 58 to facilitate manual rotation thereof. A washer 64 which may be made of a suitable material such as, for example, polytetrafluoroethylene, is optionally disposed between the flattened sections 50 and 52. The bolt 58 is disposed with its head adjacent a side of the flattened section 50 opposite the nut 60 and extends through the bore 54, the washer 64, the bore 56 and the nut 60. The attachment 42 is pivoted by loosening the bolt 58 using the handle 62. In practice, some tension is preferred to be maintained on the bolt 58 to the extent that the arm 16 is supported thereby, but the tension is sufficiently low so that the first end 44 of the arm 16 may be manipulated for repositioning of the arm 16 into the desired position. When the first end 44 of the arm 16 is in the desired pivoted position, the pivot 42 is tightened by increasing tension on the bolt 58 by means of rotation of the handle 62. The pivot attachment 48 may be constructed in a similar manner.

The sleeve 18 is generally cylindrical in cross-section and has a first longitudinal side 65 which is securely affixed to support arm 16 adjacent second end 46 thereof. A second side 66 opposite the first side 65 is provided with a longitudinal slit or aperture 68 which provides a sufficient opening to permit transverse passage of the electrical supply cord C of the lamp L therethrough. A top end 70 of the sleeve 18 is flared adjacent the aperture 60 into a generally U-shaped cross-section, and the aperture 68 is bevelled at an oblique angle so that the aperture 68 opens outwardly in a V-shaped portion 72 with a maximum width adjacent the top end 70 and a minimum width adjacent a bottom end 74 of the sleeve 18. If desired, the aperture 60 may be formed with rounded corners adjacent the top end 70 and the bottom end 74. The width of the aperture 68 is preferably sufficient to facilitate access to a switch S and an electrical outlet T conventionally provided on the handle H of the utility lamp L. The diameter of the sleeve 18 adjacent the cylindrical bottom end 74 should be sufficiently large to facilitate axial insertion of the handle H of the lamp L into the sleeve 18 with a relatively loose fit. However, the transverse dimension of the sleeve 18 adjacent the U-shaped top end 70 is sufficiently small so that the protective cage P of the lamp L is not permitted to pass therethrough. Preferably, the handle H is of variable diameter or other transverse dimension, e.g. tapered with a maximum diameter adjacent the cage P and a minimum diameter adjacent the attachment of the cord C. The diameter of the sleeve 18 is preferably greater than the diameter of the handle H adjacent the attachment of the cord C, and less than the diameter of the handle H adjacent the protective cage P.

In use of the apparatus 10 the electrical cord C of the lamp L is conventionally connected to an electrical source (not shown). The cord C is then inserted into the sleeve 18 by transverse passage thereof through the aperture 68. The handle H is then inserted axially into the sleeve 18. The apparatus 10 is particularly Well adapted for use with the lamp L wherein the handle H has a variable transverse dimension, with a smaller transverse dimension or diameter adjacent the cord C and a relatively larger diameter adjacent the protective cage P, and the smaller end of the handle H is readily inserted into the sleeve 18. As the transverse dimension of the handle H increases as it is inserted axially into the sleeve 18, the lamp L tends to be removably wedged and secured in place in the sleeve is by pressing the enlarged diameter of the handle H against the beveled surface 68 formed at top end 70 of the sleeve 18 so that the handle H abuts the continuous side 65 of the sleeve 18 while the handle H at the opposite side thereof is abutted against the aperture 68. Thus secured in place, the lamp L is positioned by placing the base 12 in the desired location, adjusting the height of the support leg 14 by means of securing means 30, and pivoting the support arm 16 at attachments 42 and 48. It is also seen that the switch s and the outlet T are readily accessible through the V-shaped opening 68 at the bevelled surface 72.

When it is desired to remove the lamp L from the apparatus 10, the reverse procedure is followed. The lamp L is withdrawn axially from the sleeve is, and then the electrical supply cord C is passed transversely through the aperture 68 so that the lamp L is free of the apparatus 10 and can be stored or used in a conventional manner, i.e. by hanging the lamp L by the hook K or retracting the cord C into a storage device therefor.

The foregoing description is illustrative and explanatory of a preferred embodiment of the invention, and variations in the size, shape, materials and other details will become apparent to those skilled in the art in view thereof. It is intended that all such variations and modifications which fall within the scope or spirit of the appended claims be embraced thereby.

What is claimed is:

1. A lamp support apparatus for holding and positioning a lamp which has a light enclosed in a cage, an elongated handle depending from the light and a switch and socket associated with the handle, and an electric supply cord fixedly attached a the end of the handle, comprising:

a base member adapted to rest on an essentially horizontal structure, said base member having a hub, a top surface and a bottom surface which bottom surface is engaged with the horizontal structure;

an upward extending support comprising an assemblage, the assemblage comprising a series of arms, each arm having a first end and a second end, wherein the second end of each of said arms is attached to the first end of a next arm of said series of arms with a pivot which may be adjusted through an angle, said attached arms being a consecutive pair of arms of said series of arms;

a leg fixedly secured to the hub of said base member for telescopically accepting the first end of an arm at a first end of the assemblage such that the arm is accepted in the leg and the consecutive arms of the assemblage can be pivoted from their respective second and first ends for configuring said upward extending support, to form a conjoined, contours shape for holding and positioned the lamp;

means for releasably securing the first end of the arm at said first end of said assemblage in said leg such that the secured arm can be rotated within said leg;

means for securely positioning the second end to the first end of said consecutive arms of said series at each said pivot for securing the arms in fixed relative position, one to the other;

a rigid, unyielding, elongated sleeve fixedly secured to a second end of the assemblage, said sleeve having a first end, a second end and a slit therebetween, the first end of said sleeve having a substantially cylindrical shape and the second end of said sleeve being flared such that the elongated handle of the lamp is securely accepted in the flared end of said sleeve such that the electric supply cord is accepted in registry with the sleeve by passing through the slit for securely engaging the handle by axial insertion in said sleeve, maintaining the electric supply cord in registry with the sleeve and providing ready access to the switch and socket on the handle of the lamp.

2. The lamp support apparatus as defined in claim 1, wherein said first and second ends of said consecutive arms are pivotable with respect to each other in a common plane defined by the pivoting of said arm at said first end of said assembly with respect to said leg.

3. The apparatus of claim 2, further comprising releasable means for securing said ends of said consecutive arms in relative fixed pivoted position.

4. The lamp support apparatus as defined in claim 1, wherein the consecutive arms are pivotable between said fist and second ends thereof in a common plane with said pivoted attachment between said support and said leg.

5. The lamp support apparatus as defined in claim 1, wherein the support may be comprised of a plurality of connected sections.

6. The lamp support apparatus as defined in claim 1, wherein the rigid, non-elastic sleeve has a generally cylindrical cross-section adjacent a bottom end of said sleeve and a flared cross-section adjacent said top end of said sleeve.

7. The lamp support apparatus as defined in claim 1, wherein the means for releasably securing the first end of the arm in said leg such that the arm can be rotated within said leg in fixed relative extended positions is comprised of a nut and a bolt assembly, wherein the nut is fixedly attached to said leg.

8. The lamp support apparatus as defined in claim 1, wherein the means for releasably securing comprises a nut and bolt assembly, wherein the bolt is disposed through the lateral ends of each of the arm and the nut engages the bolt with the arm in operative relation between the nut and bolt head.

* * * * *